US006364748B1

(12) United States Patent
Zwicker et al.

(10) Patent No.: US 6,364,748 B1
(45) Date of Patent: Apr. 2, 2002

(54) ABRASIVE RECOVERY BLASTING CABINET

(75) Inventors: Frederick Zwicker, Canfield; Robert B. Athey, Jr., Boardman, both of OH (US)

(73) Assignee: Skat Blast, Inc., Canfield, OH (US)

( * ) Notice: Subject to any disclaimer, the term of this patent is extended or adjusted under 35 U.S.C. 154(b) by 0 days.

(21) Appl. No.: 09/784,784

(22) Filed: Feb. 20, 2001

(51) Int. Cl.[7] ..... B24B 1/00

(52) U.S. Cl. ..... 451/38; 451/89; 451/90; 451/87

(58) Field of Search ..... 451/87, 88, 89, 451/90, 38, 39, 40

(56) References Cited

U.S. PATENT DOCUMENTS 3,300,902 A * 1/1967 Dockery
4,610,113 A * 9/1986 Fagerroos
4,918,873 A * 4/1990 Bass
5,143,102 A * 9/1992 Blaul ..... 134/58 R
5,177,911 A * 1/1993 Ruemelin et al. ..... 451/89
5,460,564 A * 10/1995 Bowes et al. ..... 451/89
5,556,324 A * 9/1996 Shank, Jr. ..... 451/89
5,601,480 A * 2/1997 Nilen
5,824,114 A * 10/1998 Yam et al. ..... 451/75
5,971,837 A * 10/1999 McDavid

* cited by examiner

*Primary Examiner*—Eileen P. Morgan
(74) *Attorney, Agent, or Firm*—Harpman & Harpman

(57) ABSTRACT

A blasting cabinet for use in cleaning a work piece with abrasive intrained in an air stream under pressure. An enclosure having multiple access openings and configured interior surfaces that direct spent abrasive forward to a collection area in spaced relation to the supported work piece on a solid work surface within said cabinet.

8 Claims, 5 Drawing Sheets

ABRASIVE RECOVERY BLASTING CABINET

BACKGROUND OF THE INVENTION

1. Technical Field

This invention relates to blasting cabinets that are used to conduct high pressure abrasive cleaning of articles positioned within.

2. Description of Prior Art

Prior art devices of this type have been used in industry for many years. Typically bench mounted or free standing cabinets (so called a blast cabinet) are used in which an abrasive material such as sand is propelled at high velocity by a compressed gas stream such as air directed against a surface of a work piece by a blast gun, all within the confines of the cabinet.

Examples of such blasting cabinets typically have a viewing window and a pair of sealed access gloves that allow the user to manipulate the blasting gun and article within the cabinet while being safely outside. Typically, cabinets have a collection area positioned directly below the work piece which is placed on a screen support that extends over the collection opening. The collection area on prior art blasting cabinets are funnel shaped so as the used abrasive collects within it can be picked up and reused by the gun utilizing a pick-up tube and venturia effect. In some applications a vacuum system is connected to the cabinet collecting dust and light debris particles from within the cabinet's atmosphere to a collection filter bag within the vacuum. Back-up air enters the cabinet via an air inlet which is shielded from abrasive within the cabinet; see for example U.S. Pat. Nos. 3,300,902, 5,601,480, 5,971,837 and 4,918,873.

In U.S. Pat. No. 3,300,902 a dry abrasive honing device is disclosed wherein a blasting cabinet is shown having a cyclone separator within.

U.S. Pat. No. 5,601,480 is directed to a cleaning machine that uses liquid mixture with granules that are circulated over the article within the cabinet to be cleaned.

U.S. Pat. No. 5,971,837 discloses a barrel-shaped abrasive blasting cabinet having a collection and storage hopper for the collection and feeding of blasting gun.

Finally, U.S. Pat. No. 4,918,873 illustrates an apparatus for refinishing golf clubs with an enclosure having access rubber gloves mounted in the openings in the front wall and a golf club flexible access slit in one of the sidewalls so that the club head can be positioned within the closure for cleaning.

SUMMARY OF THE INVENTION

A blasting cabinet having an interior configuration and collection hopper that enhances the circulation and effectiveness of abrasive material intraned in a high velocity air stream directed at a work piece to be cleaned. By reconfiguring and repositioning the abrasive supply and collection hopper and supporting the work piece on an integral solid surface, the unique air abrasive circulation pattern is achieved that produces a self-cleaning and collection abrasive action.

DESCRIPTION OF THE PREFERRED EMBODIMENT

Figure 1:
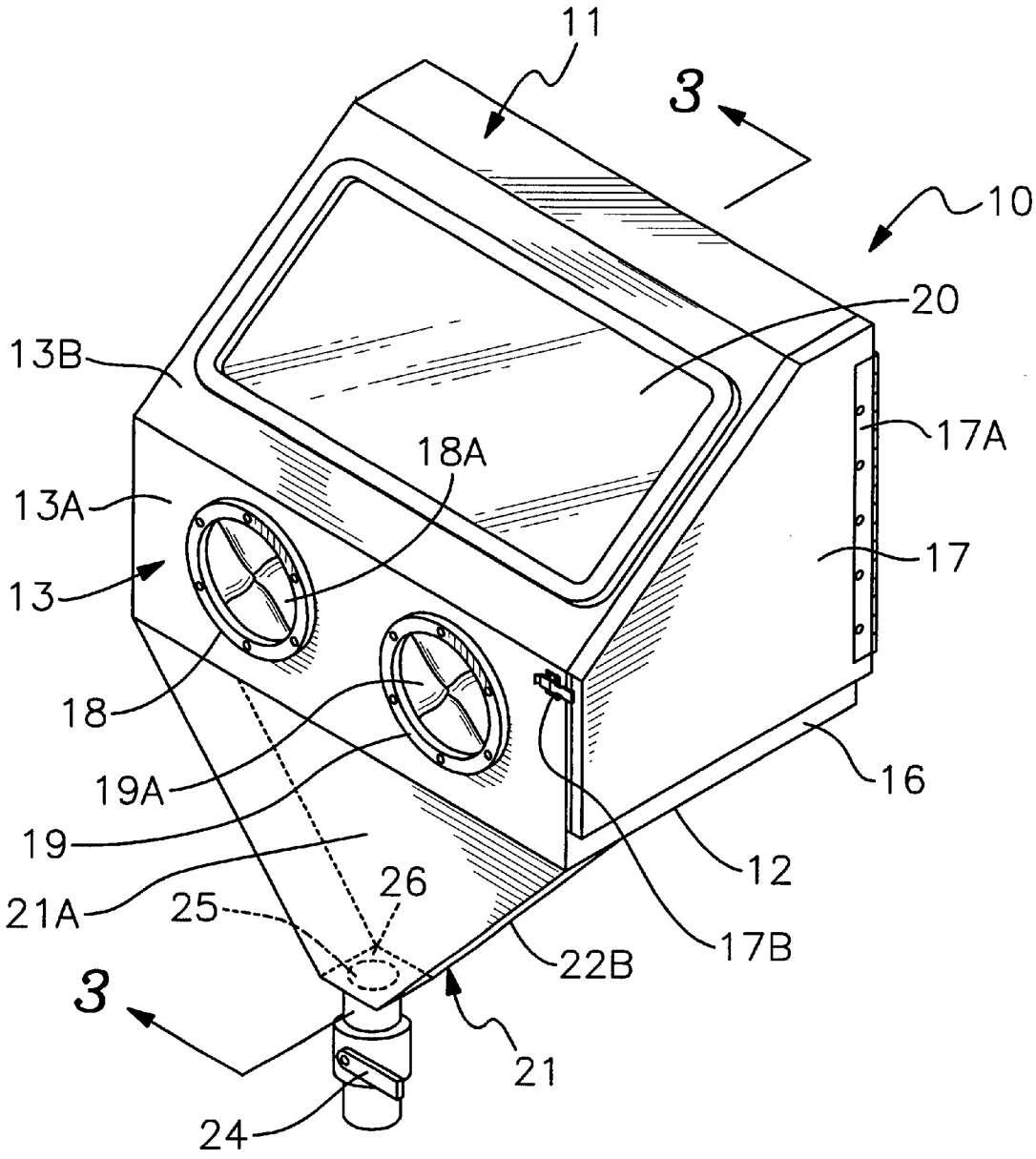
FIG. 1 is a perspective view of the blasting cabinet of the invention.
Figure 2:
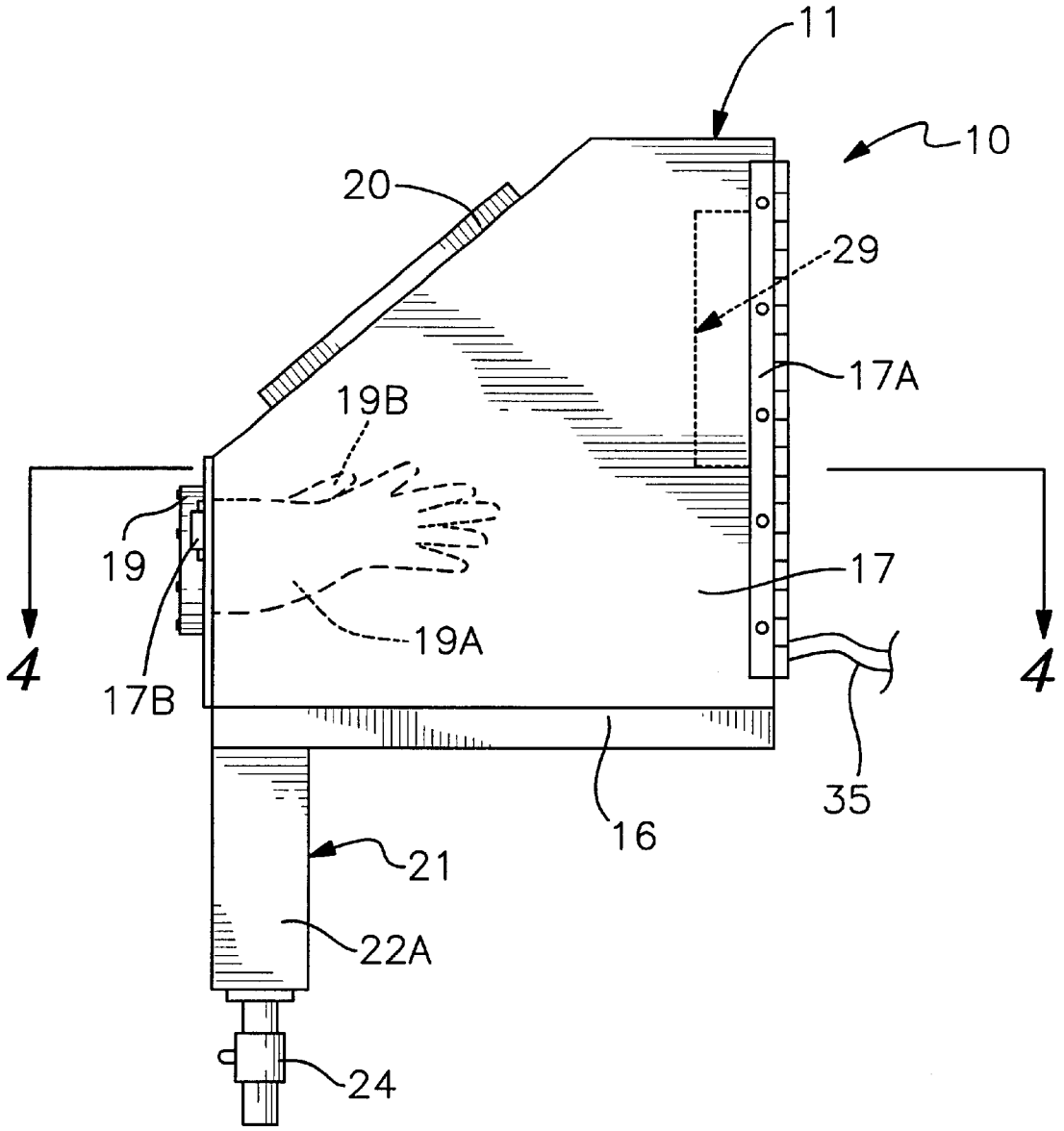
FIG. 2 it a side elevational view of the cabinet of the invention.

Referring to FIGS. 1 and 2 of the drawings, a blasting cabinet 10 of the invention can be seen having a top 11, a bottom 12 and front and back walls 13 and 14 respectively. Integral sidewalls 15 and 16 complete the cabinet enclosure with an access door 17 in the sidewall 16. The door 17 is secured to the back wall 14 by a hinge 17A and held in selective closed position by a door latch 17B.

The front wall 13 has a vertical portion 13A with a pair of openings 18 and 19 for the insertion of hands within protective flexible glove inserts 18A and 19A respectively secured to and extending from within the openings as hereinbefore described. An angle portion 13B of the front wall 13 has a viewing window 20 within as is well known and understood within the art.

Figure 3:
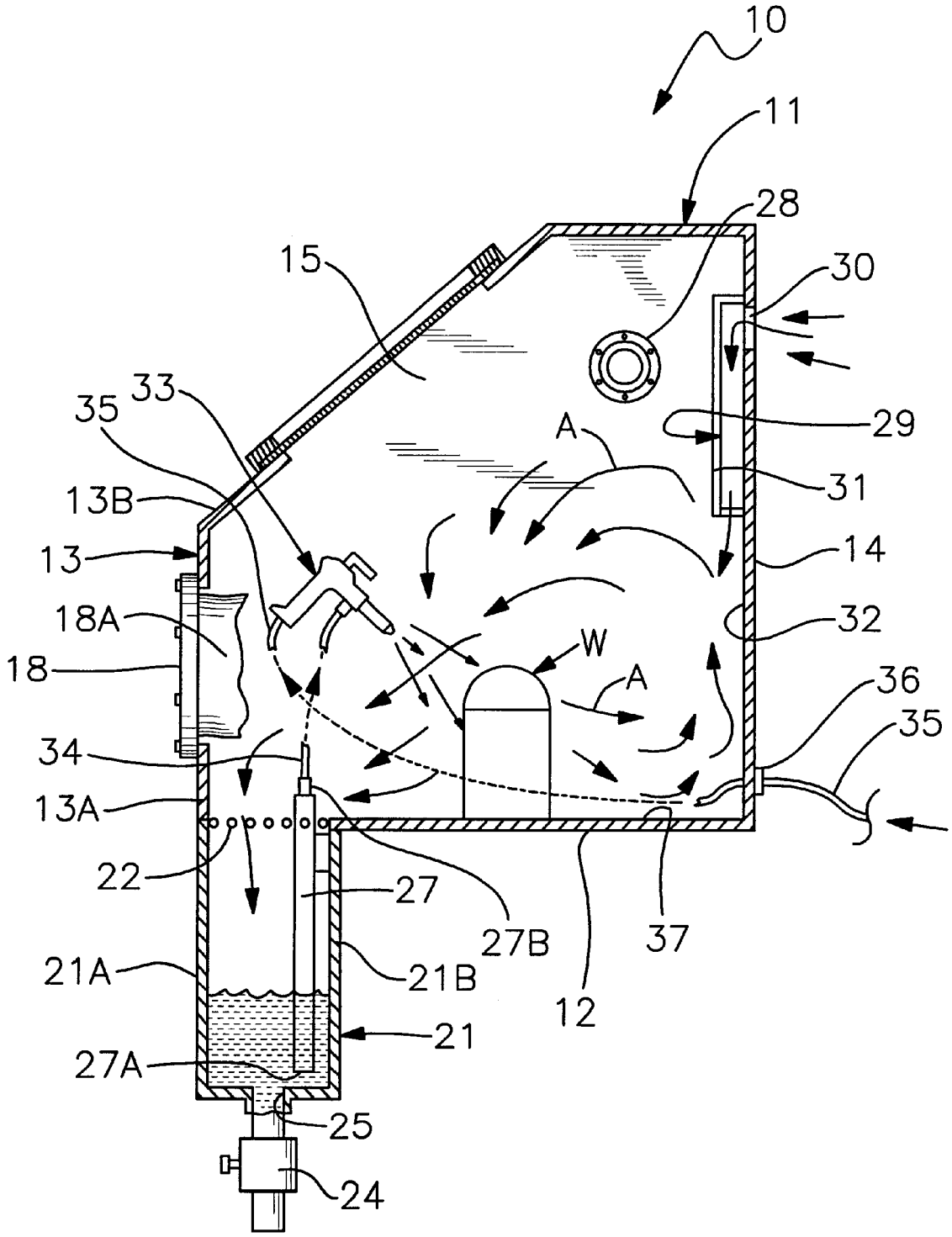
FIG. 3 is a cross-sectional view on lines 3—3 of FIG. 1.

A collection and supply funnel 21 extends from the bottom 12 defining an opening therein along the base of the vertical front wall portion 13A as best seen in FIG. 3 of the drawings. A screen 22 extends over an opening defined by the funnel forming an abrasive collection area.

The funnel 21 has parallel front and back panels 21A and 21B with interconnecting angularly inclined oppositely disposed side panels 22A and 22B. An extension tube 23 and incline gate valve 24 communicates with and extends from an outlet opening 25 within a base member 26 of the funnel that interconnects said respective panels 21A, 21B and 22A and 22B as best seen in FIG. 1 of the drawings.

A pick-up tube 27 is secured within the funnel 21 having an inlet opening 27A at one end and an oppositely disposed outlet engagement fitting 27B.

A vacuum hose attachment inlet fitting 28 extends through the sidewall 15 providing a selective access opening for the use of dust removal and vacuum system (not shown) as will be well understood by those skilled in the art. An air make-up inlet assembly 29 is positioned on the upper portion of the back wall 14 having an aperture at 30 within a rectangular baffle configuration 31 positioned thereover on the inside wall surface at 32.

In use, a power abrasive blast gun 33 is positioned within the cabinet 10 through the access door 17. The gun 33 is connected to the pick-up tube outlet 27B via an abrasive supply hose 34 and to a high pressure air source (not shown) by an air supply hose 35 that extends from within the base cabinet 10 of the invention through a hose inlet fitting 36 in the back wall 14 as best seen in FIGS. 2 and 3 of the drawings.

The power gun 33 which is typical within the art is supplied air under pressure creating a venturia effect drawing up abrasive material from within the supply and collection funnel 21 and dispensing it at high velocity through a nozzle 33A against a work piece W to be cleaned. It will be evident from the above description that the work piece W is positioned inside the blast cabinet and on a unique solid support surface 37 defined by the bottom 12 of the cabinet.

Figure 4:
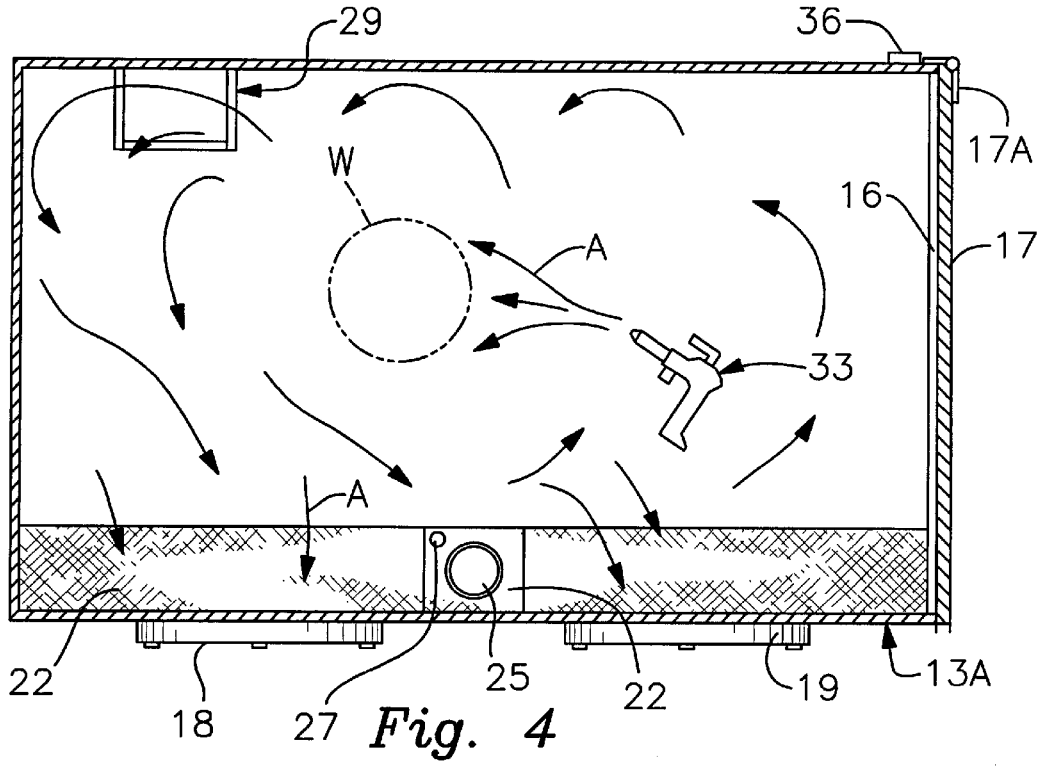
FIG. 4 is a top, plan view of the invention with portions cut away for illustrating air flow patterns graphically within during use.
Figure 5:
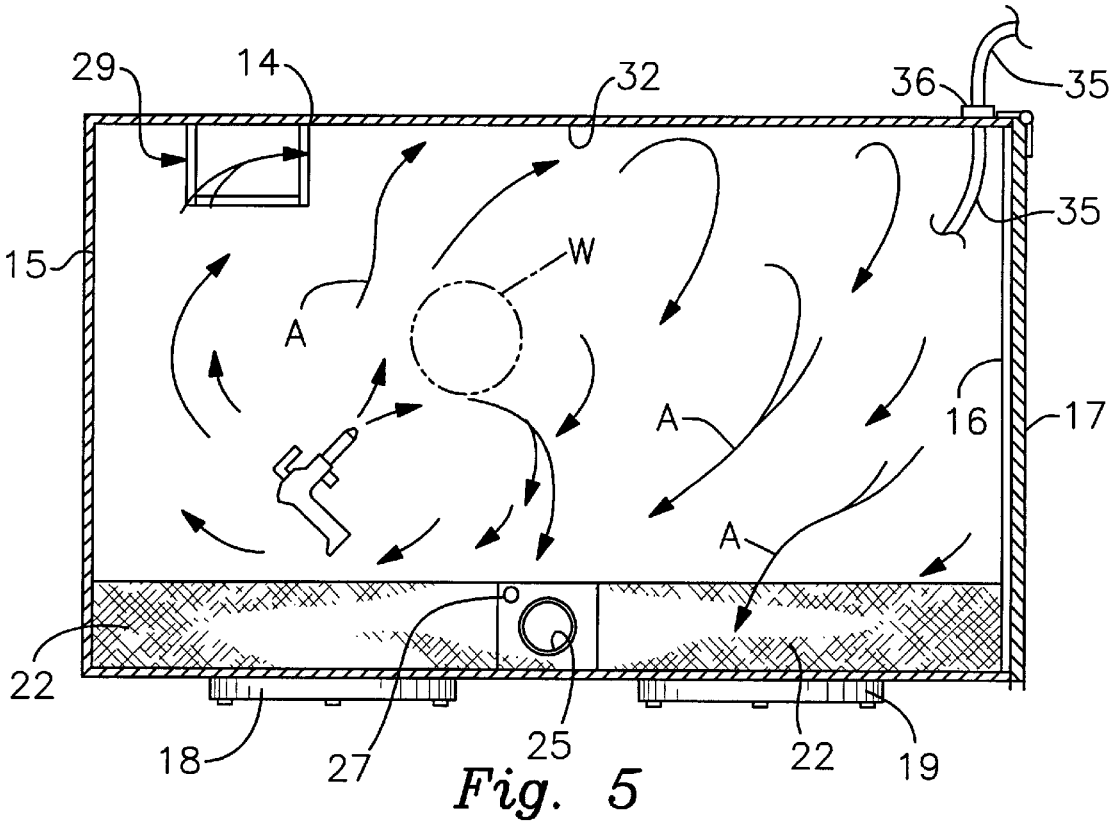
FIG. 5 is a top plan view of the invention with portions cut away for illustrating alternate air flow patterns graphically within during use.
Figure 6:
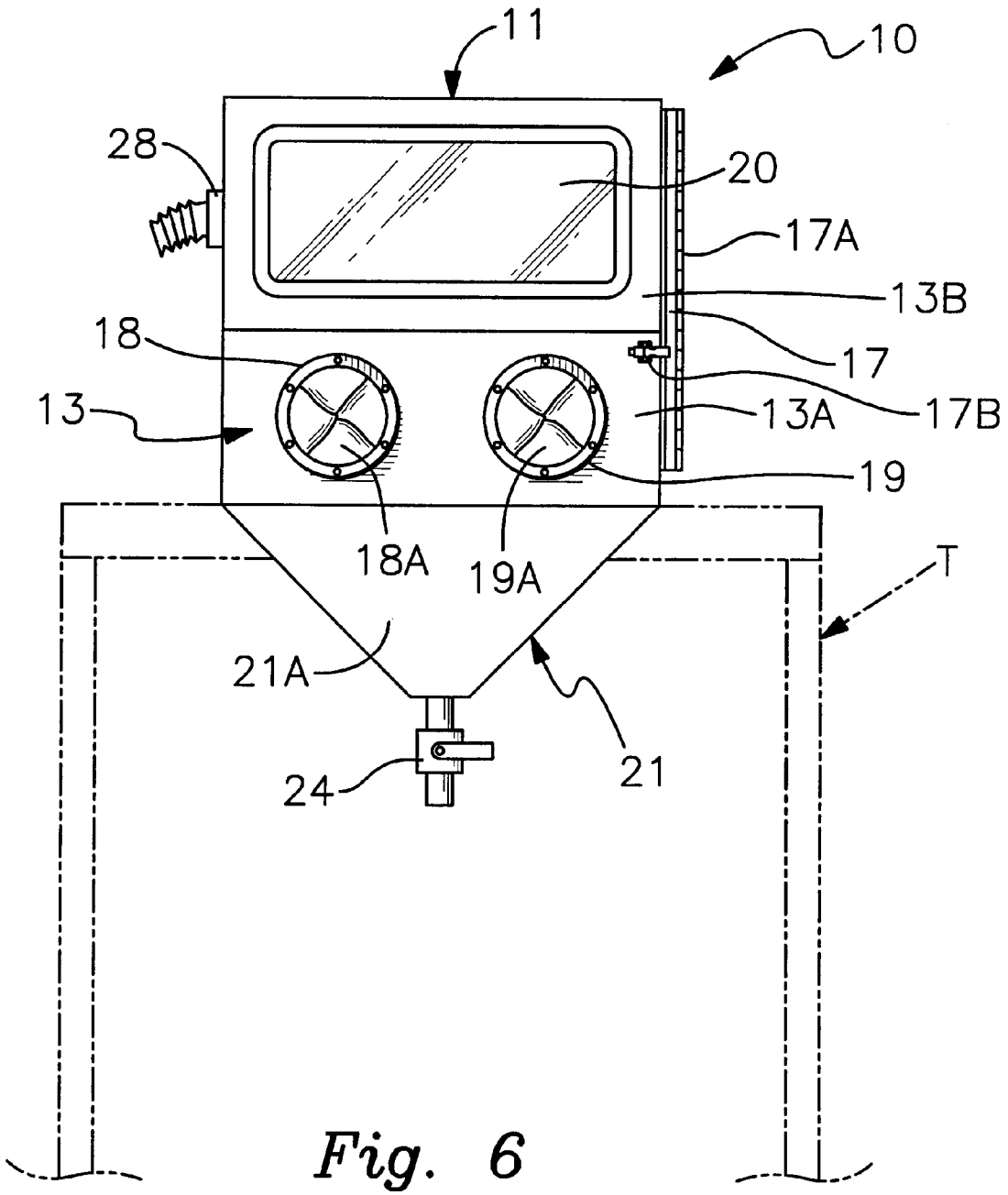
FIG. 6 is a front elevational view.

Referring now to FIGS. 3–5 of the drawings, a unique abrasive flow pattern can be seen as illustrated by directional flow arrows A. In FIG. 3 of the drawings, the abrasive flow pattern is illustrated in side elevational view wherein the abrasive strikes the work piece W and deflects around within the contoured cabinet interior of the invention due to the solid work surface 37 and its relationship to the back and side surfaces 14, 15, and 16 respectively and the intervening top and front walls 11, 13A and 13B respectively. The abrasive material as indicated by the directional flow arrows A flows around within the interior forward to the funnel opening along the base of the front wall 13A.

Referring now to FIGS. 4 and 5 of the drawings, an illustrated top plan view of the cabinet is seen showing the abrasive flow pattern arrows A from the blast gun 33 with the work piece positioned in alternate positions as would be found in a typical application use.

It will be seen that the abrasive flow patterns indicated by the abrasive flow arrows A within the high velocity air stream around within the cabinet interior surface and forward to the opening of the collection and supply funnel 21 provides a unique self-cleaning and recycling environment.

It will be apparent from the above description that a more efficient abrasive cleaning action is achieved within the blast cabinet 10 of the invention by providing the solid support surface 37 for the work piece so as to enhance the circulation within the cabinet. By having the abrasive recess opening of the collection and supply funnel 21 along the inside base of the front vertical wall portion 13A, the spent abrasive is circulated about the interior of the cabinet working its way forward to the front of the cabinet and into the collection supply funnel 21 via the cover screen 22.

It will be apparent to those skilled in the art that various changes and modifications may be made therein without departing from the spirit of the invention.

Therefore We claim:

1. A cabinet for dispensing a dry abrasive under pressure to a work piece within a cabinet comprising, a cabinet housing having a top, bottom, front and back walls with interconnecting oppositely disposed sidewalls defining an enclosure within, said front wall having an access portion and a viewing portion, a door opening and door within one of said sidewalls, openings within said access portion of said front wall through which user's hands can be inserted, a window within said viewing portion of said front wall, said bottom extending from said back wall and adjacent portions of said respective sidewalls, a collection hopper extending between said front wall access portion and bottom and said sidewall portions extending from said front wall access portion being in communication with the interior of said cabinet, a screen extending over an elongated opening defined by said hopper in planar relation to said bottom, said bottom defines a solid interior work piece support surface of a known surface dimension greater than that of said opening defined by said collection hopper, means for providing airflow through said enclosure, blasting means for dispensing abrasive within a high speed gas stream within the cabinet, and access means for supply air under pressure to said blasting means.

2. The cabinet set forth in claim 1 wherein said blasting means comprises, a power gun that draws abrasive from the hopper under vacuum created by the high speed air stream supplied to said gun from a compressed air source.

3. The cabinet as set forth in claim 2 wherein said intrained abrasive from said power gun can be directed to a work piece by the user.

4. The cabinet set forth in claim 1 wherein said collection hopper has a control outlet valve in spaced relation to said hopper inlet.

5. The cabinet set forth in claim 1 wherein said collection hopper defines a funnel extending from the interior of said cabinet, an abrasive pick-up tube within and extending from said funnel, means for interconnecting said pick-up tube with said blasting means.

6. The cabinet set forth in claim 5, wherein said means for interconnecting said pick-up tube with said blasting means comprises, a flexible tubing.

7. The cabinet set forth in claim 1 wherein said means for providing airflow through said enclosure comprises, a make-up air inlet and a vacuum outlet fitting in spaced relation to said air inlet, a source of vacuum interconnected to said vacuum outlet and baffle on said make-up air inlet in spaced relation thereto.

8. A process for cleaning a work piece and recovery of contaminated abrasive blasting material wherein said process combines the steps of, a. dispensing abrasive and air under pressure through a power gun defining a blast stream within a cabinet b. directing the blast stream of intrained abrasive against a work piece positioned on a solid interior cabinet bottom surface of a known dimension c. circulating spent abrasive against multiple interior cabinet wall surfaces and said bottom surface creating and interior air and abrasive flow pattern towards an elongated collection hopper inlet that is in planar relation to said cabinet bottom surface, said known dimension of bottom surface being greater than that of said inlet defined by said collection hopper d. collecting spent abrasive within the collection hopper e. intermixing said spent abrasive within said collection hopper for reuse in the power gun.

* * * * *